US006231634B1

(12) United States Patent
Shaw

(10) Patent No.: US 6,231,634 B1
(45) Date of Patent: May 15, 2001

(54) METHOD FOR MAKING ADDITIVES FOR ELECTRIC ARC FURNACES

(75) Inventor: Daniel J. Shaw, London (GB)

(73) Assignee: Heckett Multiserv plc, London (GB)

( * ) Notice: Subject to any disclaimer, the term of this patent is extended or adjusted under 35 U.S.C. 154(b) by 0 days.

(21) Appl. No.: 09/170,644

(22) Filed: Oct. 13, 1998

(51) Int. Cl.[7] ..... C22B 4/00

(52) U.S. Cl. ..... 75/10.59; 75/750; 75/961; 75/962

(58) Field of Search ..... 75/10.59, 10.61, 75/313, 316, 317, 319, 320, 770, 771, 962, 10.46, 10.63, 750, 749

(56) References Cited

U.S. PATENT DOCUMENTS

| | | | | |
|---|---|---|---|---|
| 4,273,575 | | 6/1981 | Litzinger et al. | 75/767 |
| 5,380,351 | * | 1/1995 | Fisher | 75/313 |
| 5,538,552 | | 7/1996 | Osing et al. | 106/697 |
| 5,573,576 | * | 11/1996 | Krofchak | 75/773 |
| 5,626,664 | * | 5/1997 | Osing et al. | 106/697 |
| 5,695,543 | * | 12/1997 | Shields | 75/10.63 |
| 5,882,374 | * | 3/1999 | Hendrix | 75/10.19 |

FOREIGN PATENT DOCUMENTS

| | | |
|---|---|---|
| 928084 | 6/1963 | (GB) . |
| 2324081 | 10/1998 | (GB) . |
| WO 9631630 | 10/1996 | (WO) . |

* cited by examiner

*Primary Examiner*—Roy King
*Assistant Examiner*—Tima McGuthry-Banks
(74) *Attorney, Agent, or Firm*—David C. Jenkins; Eckert Seamans Cherin & Mellott, LLC

(57) ABSTRACT

A method of making a pneumatically injectable additive for an Electric Arc Furnace, the method comprising screening a waste material comprising oily millscale in water to form uniform particles, and then mixing those particles with carbon and lime; and storing the mixture in air permeable bags in a dry atmosphere until the mixture has chemically cured to form the injectable particles.

11 Claims, 1 Drawing Sheet

METHOD FOR MAKING ADDITIVES FOR ELECTRIC ARC FURNACES

BACKGROUND OF THE INVENTION

1. Field of the Invention

The invention relates to additives for an electric arc furnace, and more particularly to additives containing metallic oxides which are adapted to be introduced to the furnace.

2. Prior Art

In our patent EP-A-0499779 there is a described and claimed: a method for treating a mixture consisting of solid and liquid waste materials, which contains at least one metal, in particular Fe, and/or its compounds, more especially oxides, whereby the mixture is in a state in which it is unusable or usable only with difficulty, characterised in that the mixture is at least largely homogenised and to is added at least one ultra-fine-grained dry substance comprising fly ash and/or coke, in such quantity, and blended therewith until the resulting mixture is predominantly in the form of briquettes, of which at least part can be supplied for reutilisation in a thermal process; and a method for treating a first mixture consisting of solid and liquid waste materials; which contains at least one metal, in particular Fe, and/or its compounds, more especially oxides, whereby the mixture is in a condition in which it is unusable or usable only with difficulty, characterised in that the first mixture is at least largely homogenised and to it is added at least one ultra-fine-grained dry substance, comprising fly ash and/or coke, in such quantity and blended therewith until the resulting mixture exhibits a nature which enables the classification of the resulting mixture to provide at least one fraction which can be supplied for reutilisation in a thermal process.

The method of the earlier patent works well but when other materials need to be included for addition to the furnace there are disadvantages. Usually one would mix a baghouse dust (which contains valuable recoverable toxic metals such as lead and zinc) with the mixture and then process the blend as described. The need to blend the dust with the mixture means that very large mixing plant is required, which aggravates the capital cost. Because there is much loose dust in the atmosphere there is a health hazard for operators.

GB-A-928084 discloses mixing together metallic oxide, a carbonaceous reducing agent, a hydraulic binding agent and water to form pellets which are allowed to harden without added heat. Storage takes place over one to seven days, but the conditions of storage are not identified. WO 96/31630 discloses a similar process using waste materials. Again the conditions of storage are not mentioned.

It is one object of the invention to provide a method of forming a substantially dry injectable particulate composition from waste materials in a more convenient and economic way.

SUMMARY OF THE INVENTION

In one aspect the invention provides a method of making an additive for addition to an electric arc furnace from a waste material mixture consisting of solid and liquid containing at least one metal, comprising breaking up the mixture into wet particles of substantially the same size, mixing the particles with a carbonaceous substance and a hydratable substance to form a particulate composition, and storing the composition in containers having gas permeable walls in a substantially dry atmosphere and allowing the composition to chemically cure therein to form injectable substantially dry particles.

Preferably the waste material mixture is broken up by passage through a frame having rotary parallel bars which have generally star shaped lobes, the mixture being passed in the passageway between adjacent lobes.

Typically the waste material mixture has a water content of about 10% to about 30% by weight. Typically the mixture comprises an oily millscale.

Preferably the ingredients are mixed in the weight ratios of about 70 to about 80 parts millscale or the like; about 20 to about 25 parts carbonaceous substance: balance hydratable substance.

Preferably the particles are allowed to chemically cure for a period of about 72 hours. The composition is stored in containers, typically air permeable bags, in a substantially dry atmosphere.

Preferably the cured dry particles have an average diameter of about 5 mm which makes them particularly suitable for pneumatic injection.

In another aspect the invention provides the method as described and including the subsequent step of mixing the cured particles with baghouse dust.

Preferably the ingredients are mixed in a blender, most usefully a ribbon blender. The dust is housed in a sealed hopper having an air current to encourage material flow. The particles are housed in a hopper having a stirrer to encourage the material to flow. Both materials are supplied to a screw feed into the blender. Volumetric rotary valves may be present to adjust the relative proportions.

The baghouse dust is mainly iron oxide and silica but contains useful quantities of zinc and lead.

The particles made in the first step and those made incorporating baghouse dust may be pneumatically injected into an Electric Arc Furnace.

BRIEF DESCRIPTION OF DRAWINGS

In order that the invention may be well understood it will now be described by way of example with reference to the accompanying diagrammatic drawing in which.

DETAILED DESCRIPTION OF THE PREFERRED EMBODIMENT

Figure 1:
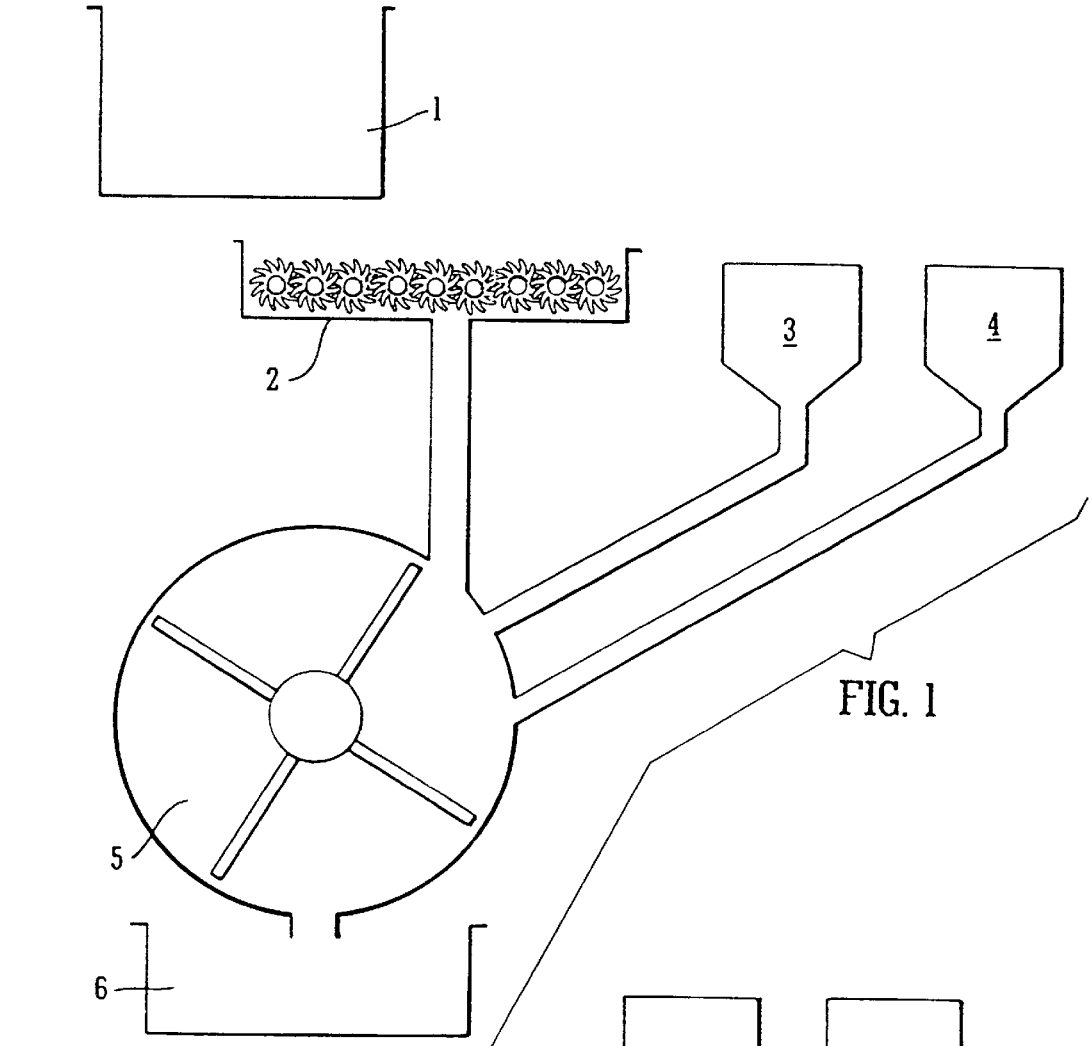
FIG. 1 is a flow diagram of one method of making particles for injection.

In the drawing of FIG. 1, an oily millscale is extracted, for example pumped or shovelled from a pond or lagoon 1, and passed through a mechanical screen 2, to remove tramp materials and leave a bulk of particulate material of substantially uniform size having a water content of 20% to 30% water. The screen may take a variety of forms, but is preferably a screen available from Machinefabrick Lubo N.V. See for example NL-A-9002165. Such a screen comprises parallel rotary bars carrying star shaped lobes which define a crellated passage through which the material is passed. The resultant substantially uniform particles are then mixed in forced mixer 5 with carbon and lime in a weight ratio of about 75:20:5 the latter two ingredients being supplied from respective hoppers 3,4. The mixture is screened at a screen 6 and bagged in large bags 7 having an air pervious wall (made of plastics, textiles or the like). The bags are left in a relatively dry atmosphere to allow the mixture to hydrate to form substantially dry particles; this takes about 72 hours. The cured particles in the bags are capable of pneumatic injection via a lance into an electric arc furnace.

Figure 2:
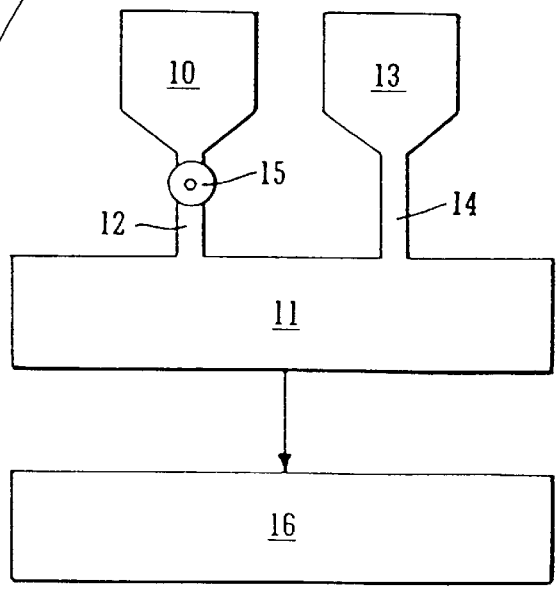
FIG. 2 is a flow diagram of a subsequent method for incorporating a supplementary metal.

As shown in FIG. 2 baghouse dust is supplied via an airtight pipe, not shown, to a sealed hopper 10. The hopper 10 is connected to a screw feed 11 via a pipe 12. The hopper 10 has an air flow inlet, not shown, to encourage material to flow via the pipe 12 to the screw feed 11. The cured substantially dry particles from the bags 7 are loaded into a hopper 13 which is connected by a pipe 14 to the screw feed 11. A volumetric rotary valve 15 is pesent in the pipe 11 to proportion the dust to the dry particles, e.g. in a weight ratio of millscale 1: baghouse dust 2. From the screw feed the ingredients are passed to a ribbon blender 16 to form bicomponent particles. Because the apparatus is sealed there is little or no exposure of operatives to toxic dust. The size of the blender can be relatively small. The product is then injected pneumatically into an Electric Arc Furnace.

The method and apparatus is not limited to the embodiment shown. Auxiliary equipment may be present such as dust extraction devices, conveyors; and the like. The method may be applied to a variety of waste materials.

What is claimed is:

1. A method of making an additive for addition to an Electric Arc Furnace from a mixture consisting of solid waste material which contains at least one metal and 10 to 30% by weight of water, the method comprising the steps of:

passing the mixture between adjacent lobes of a frame having rotary parallel bars which have generally star shaped lobes to produce wet particles of substantially uniform size, each comprising the mixture;

mixing the particles with a carbonaceous substance and a hydratable substance in a forced mixer to form a composition comprising particles of the solid containing the metal, water, the carbonaceous substance and the hydratable substance; and storing the composition in a substantially dry atmosphere in containers having gas permeable walls made of a material selected from the group consisting of plastics and textiles until the composition has chemically cured to form substantially dry injectable particles comprising the metal, the carbonaceous substance and the hydrated substance, wherein the composition is cured without the application of heat.

2. A method according to claim 1, wherein the mixture consisting of solid waste material which contains at least one metal and 10 to 30% by weight of water, and wherein the mixture is an oily millscale.

3. A method according to claim 1, wherein the composition consists of solid waste material which contains at least one metal and 10 to 30% by weight of water, and wherein, the carbonaceous substance and the hydratable substance are mixed in the weight ratio of about 70 to about 80 parts solid waste material and water mixture, about 20 to about 25 parts carbonaceous substance, and balance hydratable substance.

4. A method according to claim 1, wherein the particulate composition is allowed to cure in a substantially dry atmosphere in the containers having gas permeable walls made from a material selected from the group consisting of plastics and textiles over about 72 hours.

5. A method according to claim 1, wherein the particles of the cured particulate composition have an average diameter of about 5 mm.

6. A method according to claim 1, including the subsequent step of mixing particles of the cured particulate composition with baghouse dust.

7. A method according to claim 6, wherein the particles of the cured particulate composition and the baghouse dust are mixed in a blender.

8. A method according to claim 7, wherein the particles of the cured particulate composition and the baghouse dust are separately supplied by a screw feed to the blender.

9. A method according to claim 8, wherein the blender is a ribbon blender.

10. A method of adding an additive to an Electric Arc Furnace, the method comprising:

passing a mixture consisting of solid waste material which contains at least one metal and 10 to 30% by weight of water between adjacent lobes of a frame having rotary parallel bars which have generally star shaped lobes to produce wet particles of a substantially uniform size each comprising the mixture;

mixing the particles with a carbonaceous substance and a hydratable substance in a forced mixture to form particles of the solid containing the metal, water, the carbonaceous substance and the hydratable substance;

storing the composition in a substantially dry atmosphere in containers having gas permeable walls made from a material selected from the group consisting of plastics and textiles until the composition has chemically cured to form substantially dry injectable particles containing the metal, the carbonaceous substance and the hydrated substance, wherein the composition is cured without the application of heat;

removing the substantially dry, cured particles from the containers; and injecting those particles pneumatically into an Electric Arc Furnace.

11. A method of adding an additive to an Electric Arc Furnace, the method comprising:

passing a mixture consisting of a solid waste material which contains at least one metal and 10 to 30% by weight of water between adjacent lobes of a frame having rotary parallel bars which have generally star shaped lobes to produce wet particles of a substantially uniform size each comprising the mixture;

mixing the particles with a carbonaceous substance and a hydratable substance in a forced mixer to form particles of the solid containing the metal, water, the carbonaceous substance and the hydratable substance;

storing the composition in a substantially dry atmosphere in containers having gas permeable walls made from a material selected from the group of plastics and textiles until the composition has chemically cured to form substantially dry injectable particles containing the metal, the carbonaceous substance and the hydrated substance, wherein the composition is cured without the application of heat;

mixing the cured particles with baghouse dust in a blender to form a combined additive; and injecting the combined additive pneumatically into an Electric Arc Furnace.

* * * * *